US011162247B2

(12) United States Patent
Martinez Mane et al.

(10) Patent No.: US 11,162,247 B2
(45) Date of Patent: Nov. 2, 2021

(54) FIXING DEVICE FOR A WEAR OR PROTECTION ELEMENT ON AN EARTH MOVING MACHINE

(71) Applicant: METALOGENIA RESEARCH & TECHNOLOGIES S.L., Barcelona (ES)

(72) Inventors: Angel Martinez Mane, Barcelona (ES); Francisco Perez Soria, Barcelona (ES); Francesc Picon Manjon, Barcelona (ES); Jorge Triginer Boixeda, Barcelona (ES)

(73) Assignee: METALOGENIA RESEARCH & TECHNOLOGIES S.L, Barcelona (ES)

( * ) Notice: Subject to any disclaimer, the term of this patent is extended or adjusted under 35 U.S.C. 154(b) by 453 days.

(21) Appl. No.: 16/326,407

(22) PCT Filed: Aug. 18, 2016

(86) PCT No.: PCT/ES2016/070604
§ 371 (c)(1),
(2) Date: Feb. 19, 2019

(87) PCT Pub. No.: WO2018/033651
PCT Pub. Date: Feb. 22, 2018

(65) Prior Publication Data
US 2021/0277632 A1 Sep. 9, 2021

(51) Int. Cl.
*E02F 9/28* (2006.01)

(52) U.S. Cl.
CPC ..... *E02F 9/2833* (2013.01)

(58) Field of Classification Search
CPC ..... E02F 9/2833
(Continued)

(56) References Cited

U.S. PATENT DOCUMENTS 5,913,605 A * 6/1999 Jusselin ..... E02F 9/2883 37/451
7,328,879 B1 * 2/2008 Plangetis ..... F16M 7/00 248/188.1
(Continued)

FOREIGN PATENT DOCUMENTS

WO 2003080946 A1 10/2003
WO 2011097689 A1 8/2011
(Continued)

OTHER PUBLICATIONS

International Search Report, PCT/ES2016/070604 dated May 3, 2017.

*Primary Examiner* — Gary S Hartmann
(74) *Attorney, Agent, or Firm* — Porzio Bromberg & Newman P.C.

(57) ABSTRACT

A fixing device for fixing a wear or protection element on a shovel of an earth moving machine and the corresponding fixing system and method. Fixing device for fixing a wear or protection element (1) on a shovel (3) of an earth moving machine that comprises a stop, which is formed by a lower half-stop (7) and an upper half-stop (9) attached to one another by a screw (11), with a lower portion (31) suitable for being housed in a housing (17) arranged on a base (5) fixed to the shovel (3). Both half-stops can be separately introduced in the housing (17) through an opening (19) arranged on the upper face (21) of the wear element (1). The assembly formed by both half-stops has a plan view exceeding the perimeter of the plan view of the opening (19). The upper half-stop (9) is not in contact with the front wall (29).

10 Claims, 10 Drawing Sheets

(58) Field of Classification Search
USPC ..... 37/455, 456
See application file for complete search history.

(56) References Cited

U.S. PATENT DOCUMENTS

| | | | | |
|---|---|---|---|---|
| 10,190,290 | B2 * | 1/2019 | Gandy | E02F 9/2841 |
| 10,246,856 | B2 * | 4/2019 | Corredor | E02F 9/2841 |
| 10,947,704 | B2 * | 3/2021 | Bjerke | E02F 9/2825 |
| 2013/0185964 | A1 * | 7/2013 | Anisy | E02F 9/2825<br>37/453 |
| 2014/0202049 | A1 | 7/2014 | Ruvang | |
| 2015/0052787 | A1 * | 2/2015 | Diaz | E02F 9/2841<br>37/455 |

FOREIGN PATENT DOCUMENTS

| | | | |
|---|---|---|---|
| WO | 2015054741 | A1 | 4/2015 |
| WO | 2015089565 | A1 | 6/2015 |

* cited by examiner

FIXING DEVICE FOR A WEAR OR PROTECTION ELEMENT ON AN EARTH MOVING MACHINE

FIELD OF THE INVENTION

The invention relates to a fixing device for fixing a wear or protection element on a shovel of an earth moving machine comprising a stop with a lower portion suitable for being housed in a housing arranged on a base fixed to the shovel, where the stop is formed by a lower half-stop and an upper half-stop.

The invention also relates to a wear or protection system for a shovel of an earth moving machine comprising a fixing device according to the invention and a wear or protection element with an opening arranged on its upper face.

The invention further relates to a fixing method for fixing a wear or protection element in a mounted position on a shovel of an earth moving machine by means of a fixing device according to the invention, where the wear or protection element comprises an opening arranged on its upper face.

State of the Art

There is a plurality of earth moving machines such as excavators or loaders, for example, for working in construction jobs, mining, etc. They generally have a shovel or bucket in which the material is collected. The shovel or bucket is subjected to high stresses and significant erosion, particularly in the area of the lip (also referred to as blade). As a result, generally the lips usually have a plurality of built-in protection or wear elements:

- Teeth: for the purpose of penetrating the ground and protecting the blade of the bucket or shovel,
- Tooth bar or adapter: for the purpose of protecting the blade and especially holding the teeth,
- Front guards: for protecting the lip in the areas comprised between the teeth, and also for performing a penetration function, but to a lesser extent than the tooth,
- Side guards: for protecting the sides of the shovel or bucket.

All these elements, usually referred to as wear or protection elements, are subjected to intense mechanical stress, plastic strain and intense wear. For this reason it is common to have to replace them every so often when the wear sustained requires it. The wear or protection elements can be fixed mechanically (making them easier and quicker to change) or they can be welded (making them less expensive but difficult to change and presenting the risk of the weld damaging the blade), depending on the degree of abrasiveness of the ground and the dimensions of the machine. The front and side guards and the mechanical adapters are fixed directly to the blade by means of a fastening system, so in unloading jobs, where the material and forces act on the rear portion of the guards and adapters, the forces the guards, adapters and their fixing system receive are very high, tending to separate these elements from the blade and tending to break the fastening systems.

A particularity of the guards and some mechanical adapters is that once they are mounted, they come into frontal contact with the blade. Given the stresses of the job, the front portions of the blade deteriorate and must be repaired or rebuilt, so the machine has to be stopped, thereby increasing the operating cost and reducing machine productivity.

There are various fixing systems for fixing wear or protection elements to the lip of the shovel, such as those disclosed in patent documents US 2014/0202049 and WO 03/080946, for example. In various applications, the fixing systems cannot be accessed through the rear portion of the wear or protection element. In these cases, the wear or protection element has one (or several) openings arranged on its upper and/or side face, such as those disclosed in WO 2015/089565 and in WO 2015/054741, for example.

Under normal working conditions, wear or protection elements are subjected to a plurality of stresses in various directions. The fixing systems of the state of the art are usually designed to suitably withstand the forces acting on the wear or protection element, pushing it towards the inner portion of the shovel, i.e., against the lip and side of the shovel or bucket, during the material loading movement (hereinafter referred to as the "loading forces"). However, wear or protection elements are also subjected to forces that tend to separate them from the lip when unloading the material from the shovel ("unloading forces"). In the fixing systems of the state of the art, this stress is usually withstood by some components of the fixing system that are more "delicate," such as set screws, for example. This makes it necessary to suitably size these elements and/or use stronger materials, with the subsequent cost increase. Nevertheless, it is not uncommon for these elements to break, with the risk of the wear element becoming detached, or to strain, making their later removal difficult.

In the present description and claims, the normal working direction of the shovel, referred to as the longitudinal direction, and defining the "forward" direction as the direction moving away from the shovel and the "backward" direction as the direction moving into the shovel, has been taken into account. The expressions "front" and "rear" must be interpreted in the same way.

Expressions such as "upper" and "lower" have also been used taking into consideration that "lower" is closer to the surface of the shovel on which the wear element is fixed, and "upper" is farther away from said surface.

Similarly, the expression "vertical" must be understood as perpendicular to the surface of the shovel on which the wear element is fixed. It must be taken into account that the surface of the shovel on which the wear element is fixed can be flat, but it can also be curved, in which case the vertical will be the vertical with respect to the curved surface at the point being considered. Using the same criterion, reference is made to a horizontal plane, specifically referring to a plane parallel to the surface of the shovel on which the wear element is fixed.

Generally, all these references (front, rear, upper, lower, vertical, horizontal, etc.) must be understood as being indicative of a mere relative position with respect to the described elements, since the wear system will adopt any spatial position during use.

In the present description and claims, the "mounted position" has been defined as that position in which the fixing device is ready for being used, but it is not subjected to external stresses. In other words, it is the position in which the fixing device is located once the operator has fixed the wear or protection element to the lip of the shovel up to the working position.

It must be taken into account that the fixing device is designed for a specific wear element and base pair. As a result, the designer will be aware of all the details of both the wear element and the base affecting the wear device. Said designer will particularly be aware of all the relevant dimensions "of the surrounding area" for the design of the wear device. It must additionally be taken into account that the wear system is designed to sustain certain wear. In this sense, the expected wear of the wear system and how said wear will affect the fixing device and the dimensions of the wear element and of the base affecting the fixing device are known. Therefore, all this information must be considered to be "part of the fixing device itself" since they are pre-established values for the design thereof.

DESCRIPTION OF THE INVENTION

The object of the invention is to overcome these drawbacks. This purpose is achieved by means of a device as indicated above, characterized in that

[a] in a mounted position, the lower half-stop and the upper half-stop are attached to one another by means of a screw housed in a through hole of the upper half-stop and in a hole of the lower half-stop,

[b] the lower half-stop has a front face and a rear face, where at least a portion of the front face is in the lower portion and faces a front wall of the housing, where the lower half-stop is suitable for being vertically introduced in the housing through an opening arranged on the upper face of the wear element,

[c] the upper half-stop has a front face and a rear face, where the upper half-stop is suitable for being vertically introduced through the opening arranged on the upper face of the wear element,

[d] where the assembly formed by the lower half-stop and the upper half-stop, in the mounted position, has a plan view at least partially exceeding the perimeter of the plan view of the opening, and where, in the mounted position, the upper half-stop is not in contact with the front wall of the housing.

The housing can have virtually any shape, since it will generally depend on the shape of the base, and this shape may be determined by reasons that are independent of the present invention. In relation to the present invention, the most relevant aspect to be taken into account is that the function of the stop (as a lower half-stop and upper half-stop assembly) and the base is to prevent the wear element from shifting forward. To that end, the stop is housed in a housing having a front wall (which, in fact, is a wall of the base). When the wear element shifts forward, it pulls the stop with it until it abuts with the front wall of the housing. This retains the wear element in place. However, the area of contact between the front wall and the stop is what will sustain the forces and strain caused while the machine is working. It is therefore important for the upper half-stop to not be in contact with the front wall because if it were, the differences between the forces and the strain sustained by the upper half-stop and the forces and strain sustained by the lower half-stop would be transmitted to the screw. Alternatively, it could be said that it is necessary that there is a separation greater than a pre-established value C between the front face of the upper half-stop and the front wall of the housing. This separation C could be calculated in each case depending on the system geometry, furthermore taking into account the expected wear during the service life of the wear element and the possible effect that said wear could have on the separation between the front face of the upper half-stop and the front wall of the housing.

The device according to the invention in fact provides the following advantages:

- Access through the rear portion of the wear element for mounting the wear element on or removing it from the shovel is not necessary.
- Since it consists of two parts, introducing the device through the upper opening is easier. This allows making smaller sized upper openings, whereby improving the mechanical properties of the wear element.
- The fixing device rapidly and effectively fixes the wear element to the shovel. Particularly, the set screw is not subjected to blows or stresses that could break it, so a possible unwanted separation of the wear element from the shovel is prevented.
- The fixing device assures easy removal of the wear element after use, again as a result of the fact that the set screw is not subjected to blows or stresses that may strain it, making it difficult to unscrew it later.

As regards backward and upward shifting, these are usually limited by the actual geometry of the wear element (and/or of the base). So the wear element preferably has a concavity open in the rear portion that is suitable for housing the front edge of the shovel. On one hand, this concavity limits the backward shifting of the wear element, and on the other hand, the lower edge of this concavity limits the upward shifting of the wear element.

Preferably, in the mounted position the wear element has a rear surface facing the rear face of the upper half-stop, where there is a separation, in the longitudinal direction, greater than or equal to a pre-established value A between the rear surface of the wear element and the rear face of the upper half-stop. The wear element can in fact have a geometry such that there is no surface facing the rear face of the upper half-stop, but preferably the wear element is "closed" in the rear portion, so it will have some surface facing the rear face of the upper half-stop. In this case, not being able to transmit stresses from the wear element to the upper half-stop in the longitudinal direction is particularly advantageous. To that end it is necessary for the wear element and the upper half-stop to not be in contact with one another, but rather there must be a separation between them that is always greater than 0. This separation, having value A, could be calculated in each case depending on the geometry of the wear element; furthermore, taking into account the expected wear throughout the service life of the wear element and the possible influence of said wear on the separation between the rear face of the upper half-stop and the rear surface of the wear element. Generally, the rear face of the upper half-stop and the rear surface of the wear element do not have to be parallel to one another, but given that what is most important is that they do not come into contact with one another at any point, this pre-established value A will be measured (in the longitudinal direction) at that point where the distance between both is minimal.

Preferably, in the mounted position the wear element has a front surface facing the front face of the upper half-stop, where there is a separation, in the longitudinal direction, greater than or equal to a pre-established value B between the front surface of the wear element and the front face of the upper half-stop. In fact, during use of the shovel the wear element will receive blows and impacts on its front portion that will push it backward. The wear element will shift backward to a greater or lesser extent depending on manufacturing tolerances and sustained wear. The system is preferably designed such that the stop can freely shift backward, so it offers no resistance to the possible backward shifting of the wear element. However, there may be other constructive solutions and/or this free backward movement may be more or less blocked due to various causes (build up of dirt or stones, strain, etc.). It is therefore advantageous for there to be a separation, in the longitudinal direction, greater than or equal to a pre-established value B between the front surface of the wear element and the front face of the upper half-stop (or in other words, it is advantageous that they are not in contact with one another). As in the case of value A, value B can be calculated in each case depending on the geometry of the wear element, furthermore taking into account the expected wear throughout the service life of the wear element and the possible influence of said wear on said value B.

Generally, it is particularly advantageous for the upper half-stop to not be in contact with anything except with the lower half-stop (and with the screw joining them together), particularly for it to not be in contact with either the wear element or the base. It is therefore not possible for the upper half-stop to be subjected to a force that tries to shift it with respect to the lower half-stop, so there will not be any force that can strain or break the screw joining them together either.

Generally, minimum values of distances A, B and C will be determined depending on required tolerances and the expected wear and strain during the use of the system.

Advantageously, the lower half-stop has a plan view suitable for being positioned within the perimeter of the plan view of the opening without exceeding the perimeter of the plan view of the opening at any point, and the upper half-stop also has a plan view suitable for being positioned within the perimeter of the plan view of the opening without exceeding the perimeter of the plan view of the opening at any point. Both half-stops can thereby be introduced in (and extracted from) the housing with a simple vertical movement, i.e., without the half-stops having to perform any rotational movement.

Preferably, the assembly formed by the lower half-stop and the upper half-stop, in the mounted position, has a plan view exceeding a section of the front portion or of the rear portion of the perimeter of the plan view of said opening, and it very preferably has a plan view exceeding a section of the rear portion of the perimeter of the plan view of said opening.

The general basic concept is that once the upper half-stop is introduced in the housing through the opening of the wear element, it shifts horizontally (i.e., perpendicular to the vertical direction) such that a portion of the upper half-stop is located outside the opening (i.e., covered by the wear element). The assembly of both half-stops therefore can no longer come out of the housing since it is larger than the opening. To achieve this effect, the upper half-stop can shift in any horizontal direction. However, it is advantageous for the shifting to be in the longitudinal direction, particularly in those cases in which the wear element is an elongated part with respect to the longitudinal direction, since in these cases there is more space in the longitudinal direction. Furthermore, shifting it backward moves us away from the front portion of the wear element, which is the portion that must withstand the greatest forces and strain.

Advantageously, the through hole of the upper half-stop extends between an upper face and a lower face of the upper half-stop and defines a screw axis. The screw that will join both half-stops together can therefore also be introduced through the opening of the wear element.

Another object of the invention is a wear or protection system for a shovel of an earth moving machine, characterized in that it comprises a fixing device according to the invention and a wear or protection element with an opening arranged on the upper face of the wear or protection element, where, in a mounted position, The wear or protection element is arranged on a base fixed to the shovel, where the base has a housing below the opening, The lower portion of the stop is in the housing such that at least a portion of the front face faces a front wall of the housing, The upper half-stop is not in contact with the front wall (or, as previously described, there is a separation greater than a pre-established value C between the front face of the upper half-stop and the front wall of the housing).

Preferably, the system additionally comprises the base.

Yet another object of the invention is a fixing method for fixing a wear or protection element in a mounted position on a shovel of an earth moving machine by means of a fixing device according to the invention, where the wear or protection element comprises an opening arranged on its upper face, characterized in that it comprises the steps of:

[a] positioning the wear or protection element on a base fixed to the shovel, where the base has a housing below the opening,

[b] inserting the lower half-stop into the housing through the opening such that the lower portion is located in the housing, where at least a portion of the front face faces a front wall of the housing,

[c] inserting the upper half-stop through the opening,

[d] shifting the upper half-stop with respect to the lower half-stop until the through hole and the hole coincide with one another, thereby achieving the mounted position,

[e] inserting the screw into the through hole and the hole.

Preferably, the shifting in step [d] is in the longitudinal direction, and it is very preferably a backward shifting.

BRIEF DESCRIPTION OF THE DRAWINGS

Other advantages and features of the invention will be understood from the following description of several non-limiting preferred embodiments of the invention in reference to the attached drawings, in which.

DETAILED DESCRIPTION OF SEVERAL EMBODIMENTS OF THE INVENTION

Figure 1:
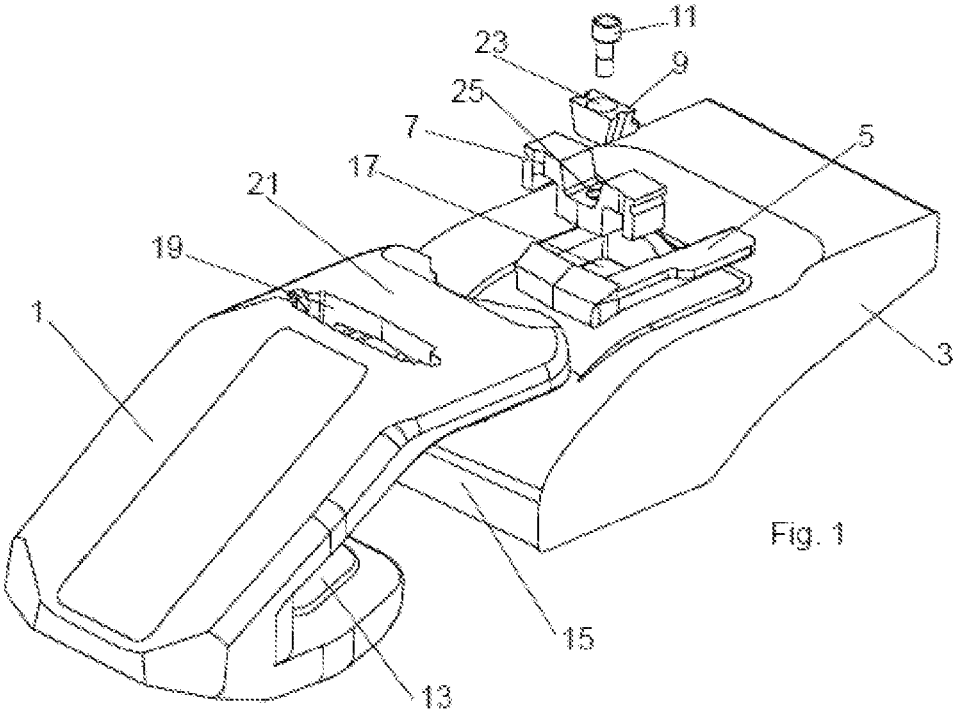
FIG. 1 shows an exploded front perspective view of a first embodiment of a fixing device and system according to the invention.

FIGS. 1 to 12 show a first embodiment of a fixing device for fixing a wear or protection element 1 on a shovel 3 of an earth moving machine and its corresponding system. The system comprises the wear element 1, a base 5 fixed to the shovel 3 of the earth moving machine, a lower half-stop 7, an upper half-stop 9 and a screw 11.

Figure 2:
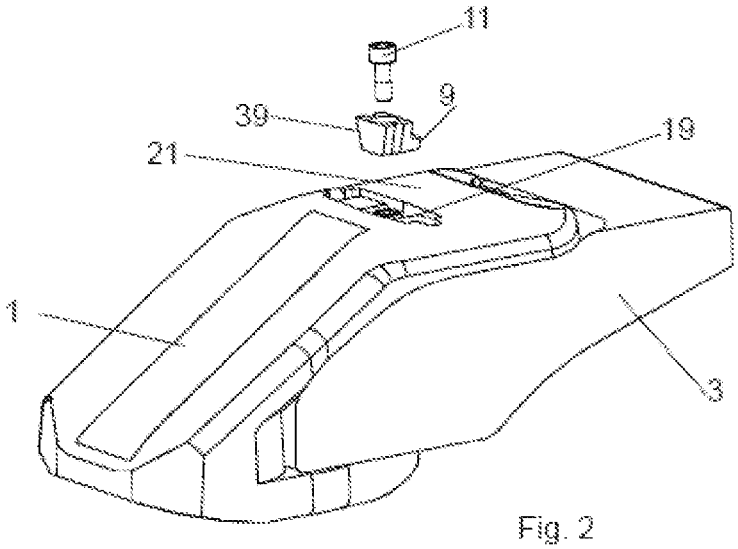
FIG. 2 shows a partially exploded front perspective view of the system of FIG. 1.
Figure 3:
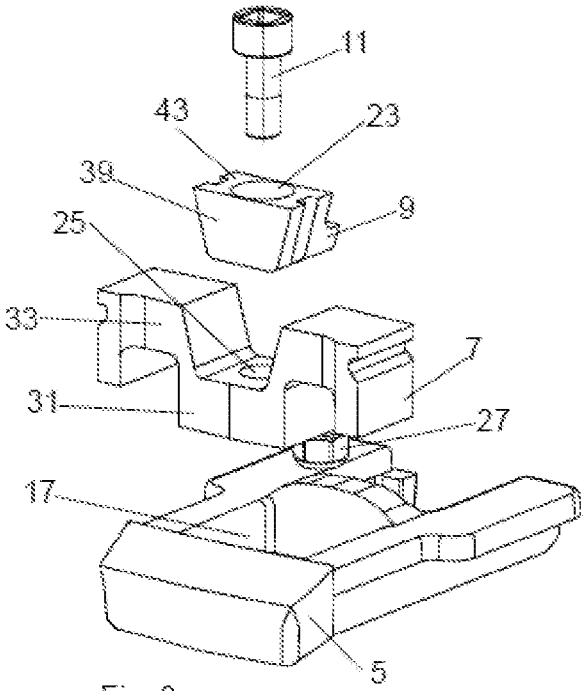
FIG. 3 shows an exploded front perspective view of the fixing device of FIG. 1 and its corresponding base.
Figure 4:
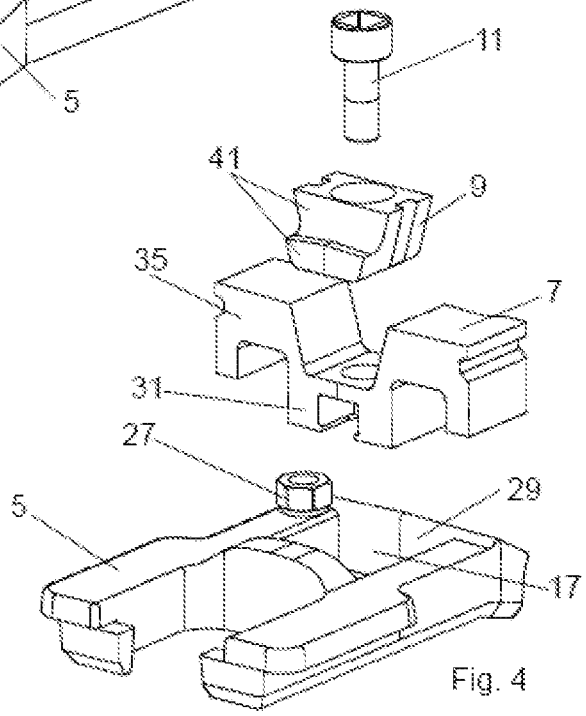
FIG. 4 shows an exploded rear perspective view of the fixing device of FIG. 1 and its corresponding base.
Figure 5:
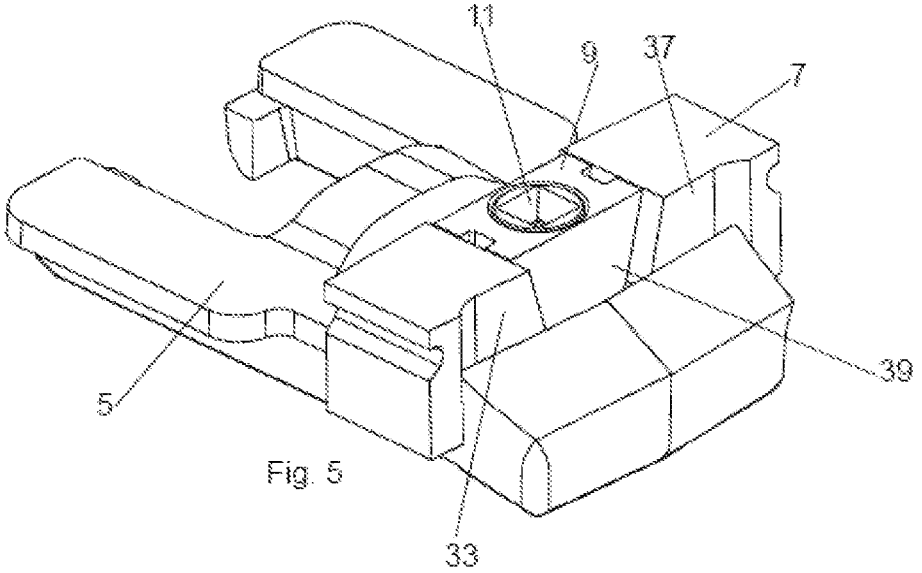
FIG. 5 shows a front perspective view of the assembly of FIG. 3 in the mounted position.
Figure 6:
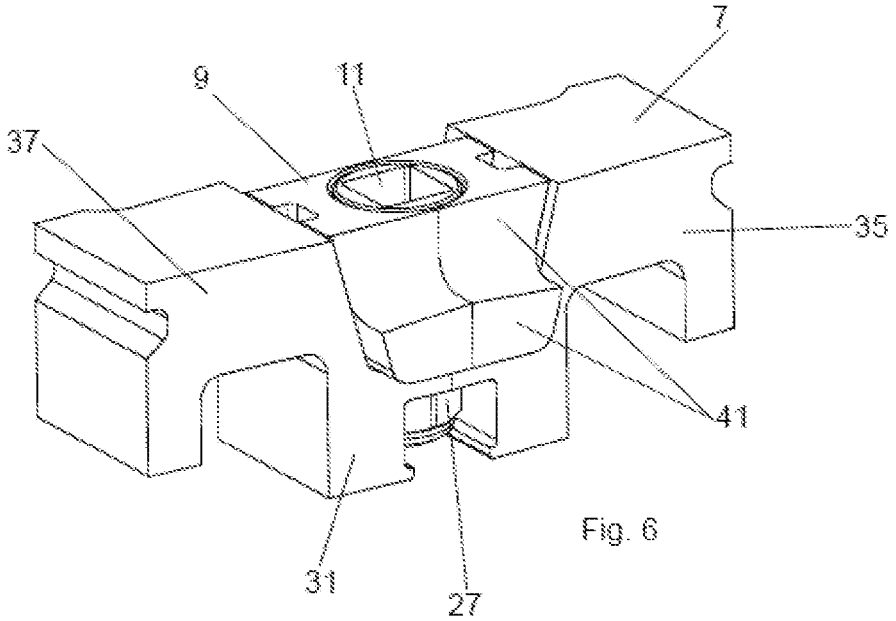
FIG. 6 shows a rear perspective view of the fixing device of FIG. 3 in the mounted position.
Figure 7:
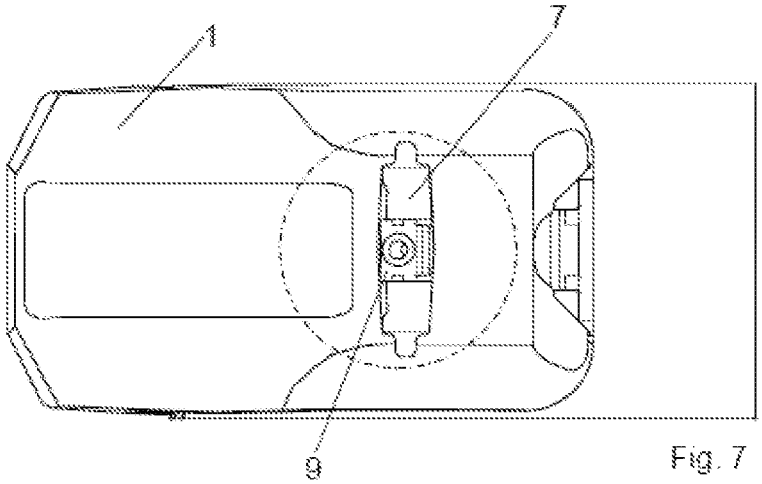
FIG. 7 shows a top plan view of the system of FIG. 1 in a partially mounted position, before positioning the upper half-stop in its final location.

The base 5 is usually fixed to the shovel 3 by means of welding (although other fixing means are also possible) since the base 5 usually does not have to be replaced with another one often, i.e., when one wear element 1 must be replaced with another one, it is possible to use the same base 5. To mount the wear element 1, the wear element 1 is positioned on the lip of the shovel 3 such that its concavity 13 partially envelopes the front edge 15 of the shovel 3. The upper portion of the wear element 1 covers the base 5 such that a housing 17 arranged in the base 5 is vertically aligned with an opening 19 arranged on the upper face 21 of the wear element 1. The lower half-stop 7 is then introduced through the opening 19 by means of a vertical translation movement, such that it is housed in the housing 17. The upper half-stop 9 is then introduced through the opening 19, the upper half-stop 9 shifts backward until a through hole 23 in the upper half-stop 9 coincides with a hole 25 in the lower half-stop 7, and the screw 11 is introduced in these holes 23 and 25. In this embodiment, the hole 25 of the lower half-stop 7 is also a through hole and the screw 11 is screwed into a nut 27 arranged at the opposite end of the hole 25 of the lower half-stop 7. FIG. 2 depicts the moment in time when the lower half-stop 7 has already been introduced in the housing 17 through the opening 19 but the upper half-stop 9 has not yet been introduced.

The housing 17 has a front wall 29 which is a wall of the base 5. In turn, the lower half-stop 7 has a lower portion 31 housed in the housing 17. The lower half-stop 7 also has a front face 33 and a rear face 35. The portion of the front face 33 that is in the lower portion 31 faces the front wall 29 of the housing 17, and during normal working of the system, they may come into contact with one another. In fact, the front wall 29 will be what limits the forward movement of the lower half-stop 7 (and accordingly of the wear element 1). In turn, the upper portion 37 of the lower half-stop 7 projects from the housing 17 and is located in the opening 19, such that the lower half-stop 7 is pulled by the wear element 1 in its possible movements in the longitudinal direction.

Figure 11:
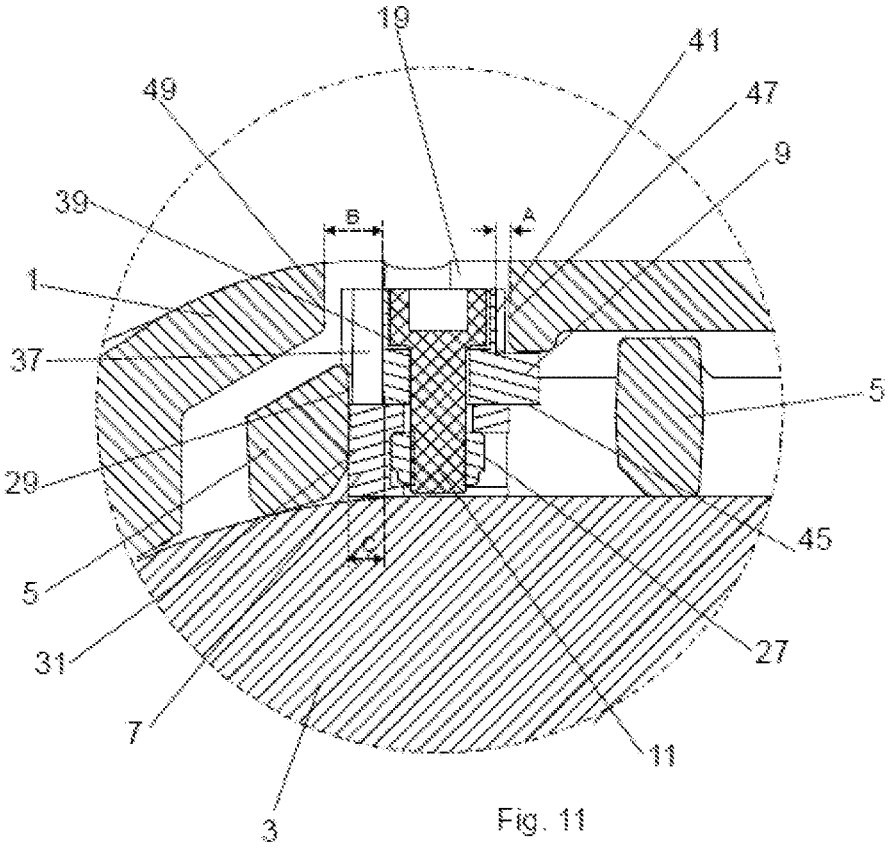
FIG. 11 shows an enlarged partial view of FIG. 10.
Figure 12:
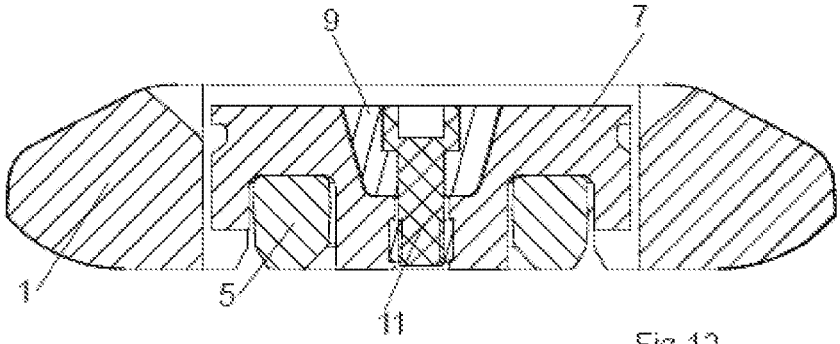
FIG. 12 shows a cross-section view of the system of FIG. 1 in the mounted position.
Figure 13:
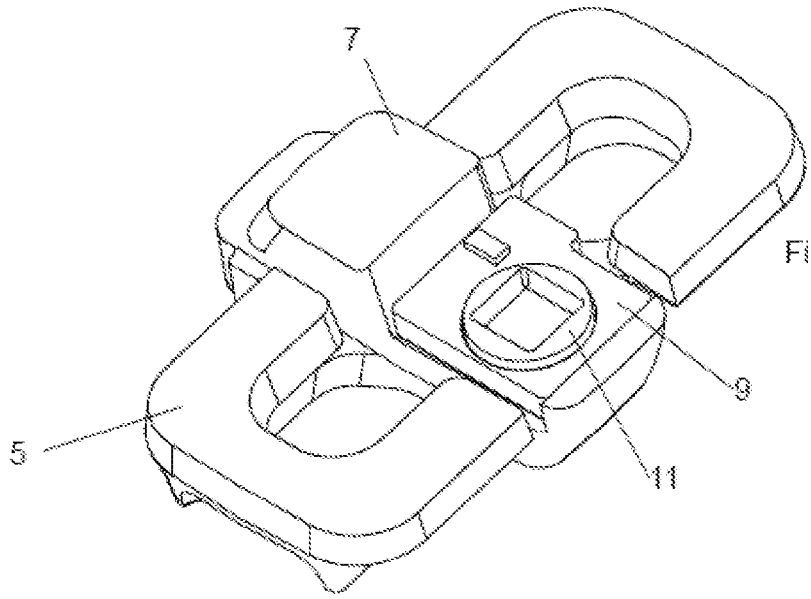
FIG. 13 shows a front perspective view of a second embodiment of a device according to the invention and its corresponding base.
Figure 14:
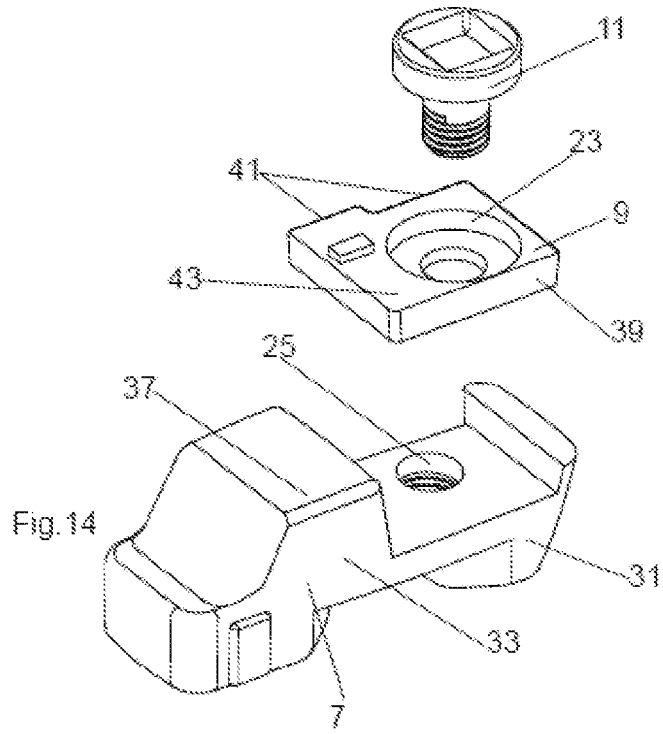
FIG. 14 shows an exploded front perspective view of the device of FIG. 13.
Figure 15:
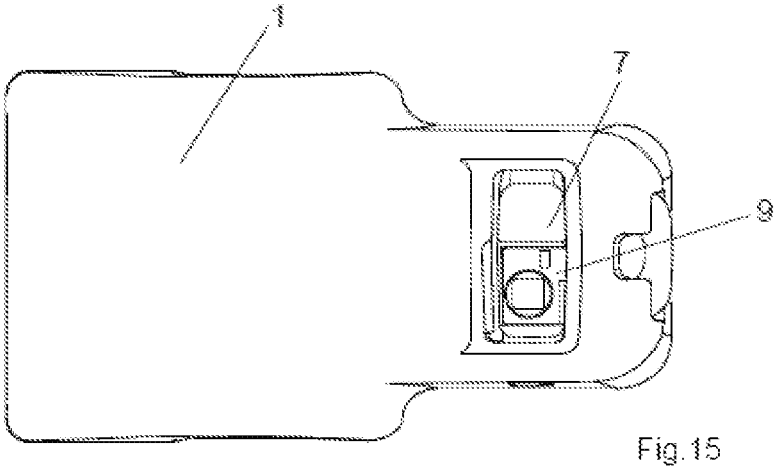
FIG. 15 shows a top plan view of a system with the device of FIG. 13 in the mounted position, with the upper half-stop in its final location.
Figure 16:
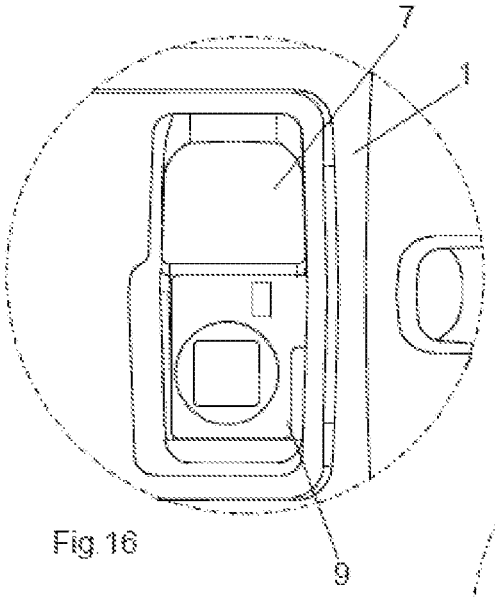
FIG. 16 shows an enlarged partial view of FIG. 15.
Figure 17:
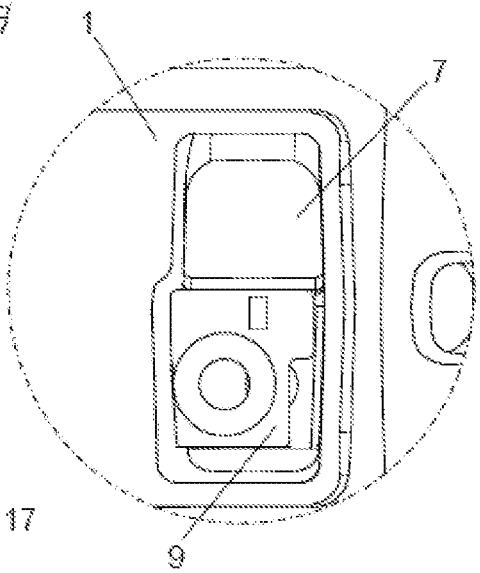
FIG. 17 shows a view equivalent to FIG. 16, but before the upper half-stop has shifted to its final position.
Figure 18:
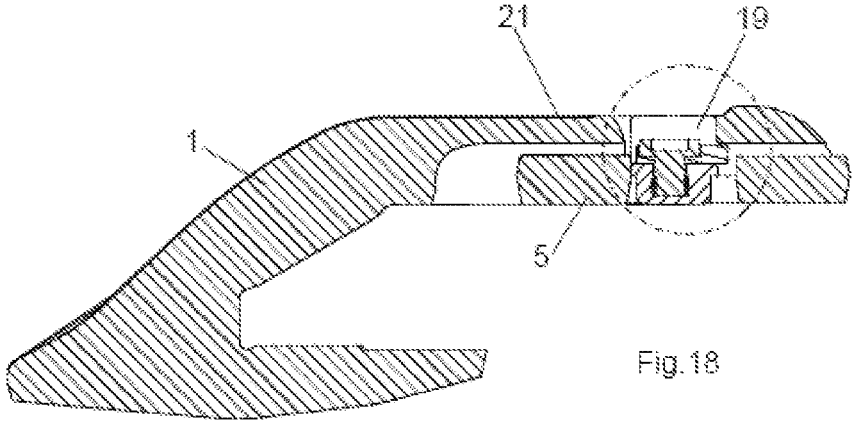
FIG. 18 shows a longitudinal section view of the system of FIG. 15.
Figure 19:
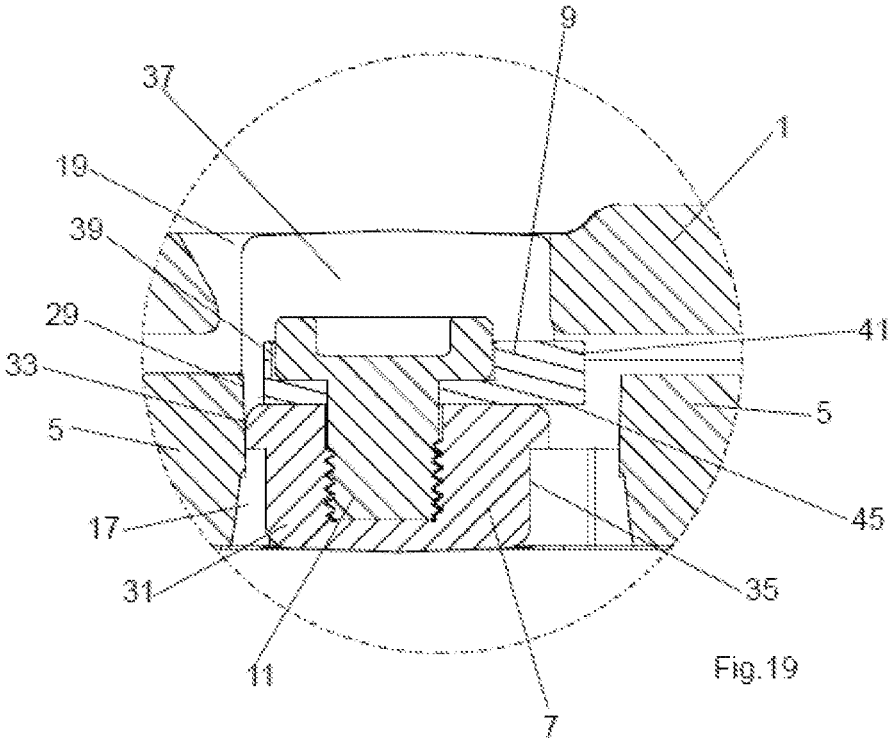
FIG. 19 shows an enlarged partial view of FIG. 18.
Figure 20:
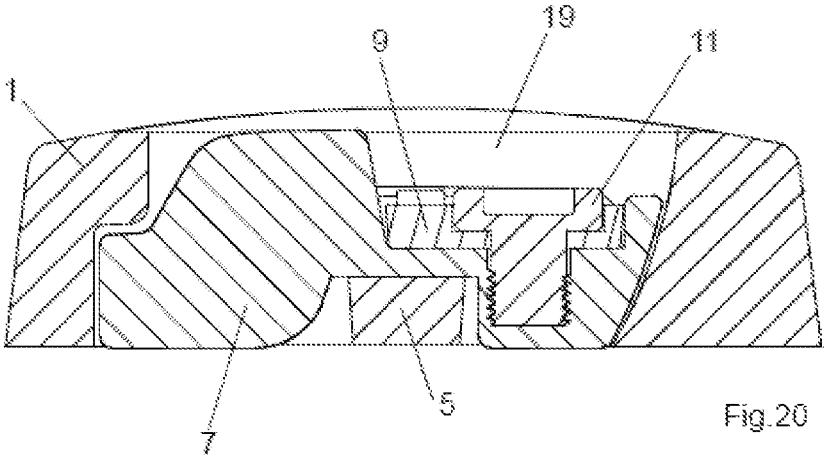
FIG. 20 shows a cross-section view of the system of FIG. 15.

The upper half-stop 9 has a front face 39, a rear face 41, an upper face 43 and a lower face 45. None of the faces of the upper half-stop 9 is in contact with any element except with the lower half-stop 7 (and the screw 11 joining them). FIG. 11 depicts the separations of values A (between the rear face 41 of the upper half-stop 9 and a rear surface 47 of the wear element 1), B (between the front face 39 of the upper half-stop 9 and the front wall 29 of the housing 17) and C (between the front face 39 of the upper half-stop 9 and the front surface 49 of the wear element 1). All of them are greater than 0.

Figure 8:
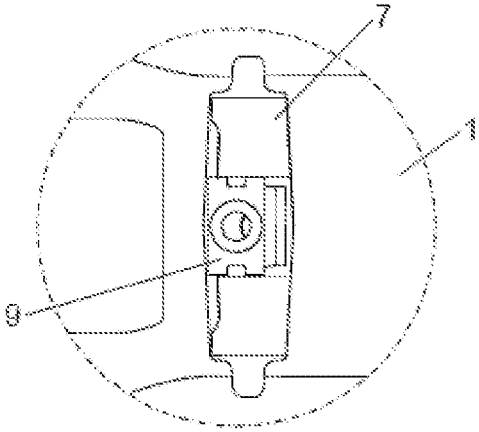
FIG. 8 shows an enlarged partial view of FIG. 7.
Figure 9:
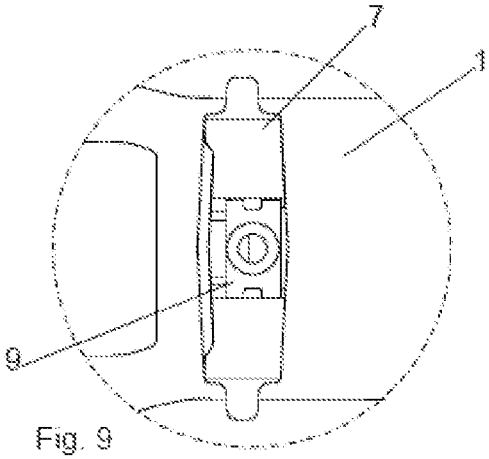
FIG. 9 shows a view equivalent to FIG. 7, but with the upper half-stop in its final position.
Figure 10:
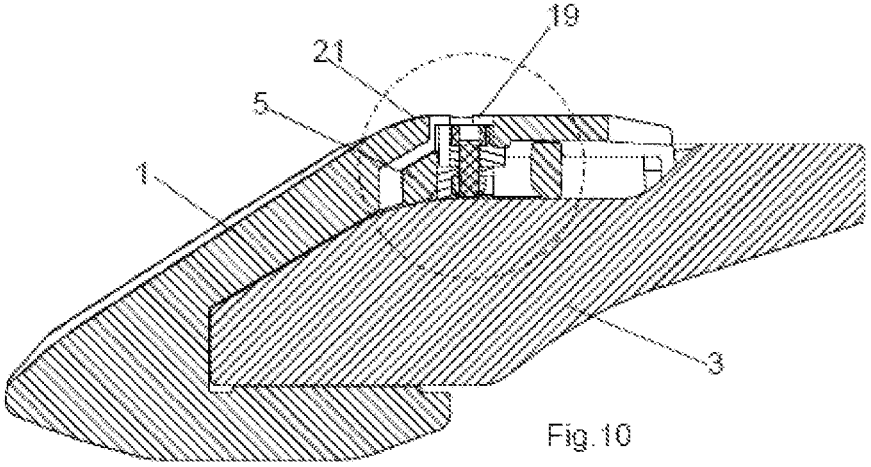
FIG. 10 shows a longitudinal section view of the system of FIG. 1 in the mounted position.

FIG. 8 shows how both the upper half-stop 9 and the lower half-stop 7 have a plan view that is smaller than the plan view of the opening 19, so they can be introduced in the housing 17 through the opening 19 by means of simple vertical shifting. Then (FIG. 9) the upper half-stop 9 is shifted backward, at which point the through hole 23 of the upper half-stop 9 and the hole 25 of the lower half-stop 7 coincide and the screw 11 can be introduced therein. At this point in time, the plan view of the stop (the assembly of both half-stops) extends behind the plan view of the opening 19, so the stop cannot come out of the housing 17.

FIGS. 13 to 20 show another embodiment of a fixing device (and its corresponding system) according to the invention. The system comprises the wear element 1, a base 5 fixed to the shovel 3 of the earth moving machine, a lower half-stop 7, an upper half-stop 9 and a screw 11.

It generally shares all that which has been explained above with the previous embodiment. The following can be remarked as being different elements:

- The hole 25 of the lower half-stop 7 is not a through hole but has a threaded blind end. Therefore, the screw 11 is screwed directly into the lower half-stop 7 without requiring a nut.
- The lower half-stop 7 has a plan view that is larger than the plan view of the opening 19 (see FIG. 20). However, it is possible to introduce the lower half-stop 7 in the housing 17 through the opening 19 by means of a rotational movement: the lower half-stop 7 is introduced in the opening 19 in an inclined position, such that the left portion (according to FIG. 20) of the lower half-stop 7 is housed in the housing 17. Then by means of rotation or pivoting of the lower half-stop 7, the rest of the lower half-stop 7 is introduced in the housing 17.
- The upper half-stop 9 is located at all times below the upper portion of the wear element 1, so neither the rear surface 47 nor the front surface 49 of the wear element 1 exists.

The invention claimed is:

1. A fixing device for fixing a wear or protection element on a shovel of an earth moving machine comprising a stop with a lower portion suitable for being housed in a housing arranged on a base fixed to said shovel, said stop being formed by a lower half-stop and an upper half-stop, wherein

- in a mounted position, said lower half-stop and said upper half-stop are attached to one another by means of a screw housed in a through hole of said upper half-stop and in a hole of said lower half-stop,
- said lower half-stop has a front face and a rear face, where at least a portion of said front face of the lower half-stop is in said lower portion and faces a front wall of said housing, where said lower half-stop is suitable for being introduced in said housing through an opening arranged on the upper face of said wear element,
- said upper half-stop has a front face and a rear face, where said upper half-stop is suitable for being vertically introduced through said opening arranged on the upper face of said wear element,
- where the assembly formed by said lower half-stop and said upper half-stop, in said mounted position, has a plan view at least partially exceeding the perimeter of the plan view of said opening,
- and where, in said mounted position, said upper half-stop is not in contact with said front wall.

2. The device according to claim 1, wherein in said mounted position, said wear element has a rear surface facing the rear face of said upper half-stop, where there is a separation, in the longitudinal direction, greater than or equal to a pre-established value A between said rear surface of the wear element and said rear face of the upper half-stop.

3. The device according to claim 1, wherein in said mounted position, said wear element has a front facing surface facing the front face of said upper half-stop, where there is a separation, in the longitudinal direction, greater than or equal to a pre-established value B between said front surface of the wear element and said front face of the upper half-stop.

4. The device according to claim 1, wherein said lower half-stop has a plan view suitable for being positioned within the perimeter of the plan view of said opening without exceeding the perimeter of the plan view of said opening at any point, and said upper half-stop also has a plan view suitable for being positioned within the perimeter of the plan view of said opening without exceeding the perimeter of the plan view of said opening at any point.

5. The device according to claim 1, wherein the assembly formed by said lower half-stop and said upper half-stop in said mounted position has a plan view exceeding a section of the front portion or of the rear portion of the perimeter of the plan view of said opening, and preferably has a plan view exceeding a section of the rear portion of the perimeter of the plan view of said opening.

6. The device according to claim 1, wherein said through hole extends between an upper face and a lower face of said upper half-stop and defines a screw axis.

7. A wear or protection system for a shovel of an earth moving machine, wherein the system comprises a fixing device according to claim 1, and a wear or protection element with an opening arranged on the upper face of said wear element, where, in a mounted position, said wear element is arranged on a base fixed to said shovel, where said base has a housing below said opening, said lower portion of said stop is in said housing such that at least a portion of said front face of said lower half-stop faces a front wall of said housing, and said upper half-stop is not in contact with said front wall.

8. The system according to claim 7, wherein the system additionally comprises said base.

9. A fixing method for fixing a wear or protection element in a mounted position on a shovel of an earth moving machine by means of a fixing device according to claim 1, where said wear element comprises an opening arranged on the upper face of said wear element, wherein the method comprises the steps of:

[a] positioning said wear element on a base fixed to said shovel where said base has a housing below said opening,

[b] inserting said lower half-stop into said housing through said opening such that said lower portion is located in said housing, where at least a portion of said front face of said lower half-stop faces a front wall of said housing,

[c] inserting said upper half-stop through said opening,

[d] shifting said upper half-stop with respect to said lower half-stop until said through hole and said hole coincide with one another, thereby achieving said mounted position, and

[e] inserting said screw into said through hole and said hole.

10. The method according to claim 9, wherein in said step [d], said shifting is in the longitudinal direction, and it is preferably backward shifting.

* * * * *